US006279164B1

(12) United States Patent
Martin

(10) Patent No.: US 6,279,164 B1
(45) Date of Patent: Aug. 28, 2001

(54) INTERLOCKING BATTING GLOVES EMPLOYING HOOK AND LOOP FASTENERS

(76) Inventor: G. Reed Martin, 6142 Kimberly Elise Rd., Bartlett, TN (US) 38135

( * ) Notice: Subject to any disclaimer, the term of this patent is extended or adjusted under 35 U.S.C. 154(b) by 0 days.

(21) Appl. No.: 09/626,756

(22) Filed: Jul. 27, 2000

(51) Int. Cl.[7] ..... A41D 19/00
(52) U.S. Cl. ..... 2/161.1; 473/458
(58) Field of Search ..... 2/159, 161.1, 161.2, 2/161.3, 161.4, 161.5, 163; 473/458, 205, 300, 451, 464

(56) References Cited

U.S. PATENT DOCUMENTS 5,028,050 * 7/1991 Freyer ..... 273/183
5,184,815 * 2/1993 Maddox ..... 273/26
5,542,126 * 8/1996 Harvanek ..... 2/161.2
5,704,065 * 1/1998 Feuerhake ..... 2/161.2
6,006,358 * 12/1999 Keating ..... 2/161.1
6,212,687 * 4/2001 Kwon ..... 2/161.3

* cited by examiner

*Primary Examiner*—John J. Calvert
*Assistant Examiner*—Katherine Moran
(74) *Attorney, Agent, or Firm*—Sanford J. Asman

(57) ABSTRACT

A pair of interlocking batting gloves which may be worn by a batter during practice and during play in which each glove has a portion of hook and loop material attached to the outer peripheral edge of the index finer and a cooperating portion of hook and loop material attached to the outer peripheral edge of the little finger. When the batter grips a bat in the proper manner, the hook and loop material on the index finger of one hand releasably connects to the cooperating portion of hook and loop material on the little finger of the other hand. Thus, when wearing the gloves, the batter is prevented from rotating his hands while gripping the bat and the proper alignment of the batter's knuckles is maintained throughout the entire swing.

5 Claims, 7 Drawing Sheets

INTERLOCKING BATTING GLOVES EMPLOYING HOOK AND LOOP FASTENERS

BACKGROUND OF THE INVENTION

The present invention relates, to gloves worn during athletic sports. In particular, the invention relates to interlocking gloves which improve the performance and skill of an athlete participating in an athletic sport which requires the athlete to hold and grip a piece of sports equipment such as a baseball bat.

In baseball, softball, and similar sports, it is essential for proper swing of the bat that the batter's hands maintain proper grip placement and proper knuckle alignment throughout the entire swing. There is a tendency, however, especially for young children and beginning adults to rotate their hands in opposite directions on the bat while waiting for a pitch or during the swing. When this happens, the batter loses proper knuckle alignment, and the bat is forced through the swing at an improper angle thereby resulting in an improper follow-through of the batter's swing.

In order to create a better "grip" on the bat and in order to eliminate some of the natural "slipping" that may occur, many batters wear a batting glove or a pair of batting gloves. Although the batting gloves heretofore known may enhance the batter's grip and prevent some degree of slippage on the bat, many batters still tend to rotate their hands while waiting for a pitch or unintentionally during the follow-through of the swing.

As a result of these deficiencies, the gloves of the prior art were often modified to add padding or slip resistant materials in a variety of areas. While the batting gloves shown in the prior art provide some degree of protection to the batters and may prevent some degree of accidental slippage, none of them are designed to, or successfully, prevent a batter from rotating his hands while gripping a bat.

While the prior art discloses a number of interlocking gloves intended for use by athletes, none of the previously known athletic gloves has a design in which a solution to maintaining proper knuckle alignment of a batter has been taught.

By way of example, the prior art shows U.S. Pat. No. 3,508,280 entitled INTERLOCKING GOLF GLOVES which issued on Apr. 28, 1970 to C. W. Osborn. The gloves described by Osborn must be designed for use by either a right-handed, or a left-handed, golfer. In one embodiment, the gloves include an elongated fastener strip on the thumb of one glove which interlocks with a rectangular strip in the palm of the other glove. A second set of fasteners on the tip of the little finger of one glove interlocks with a U-shaped piece on the rear of the other glove. The issue of flexibility of the fastener strips is not present, as the thumb of a golfer is substantially straight in the standard golf grip, whereas the little finger strip does not go over any joints. In an alternative embodiment shown by Osborn, there are cooperative fasteners on a single glove and on the grip of the golf club itself.

U.S. Pat. No. 4,587,673 entitled VOLLEYBALL PRACTICE GLOVES which issued on May 13, 1986 to G. A. Boliard describes interlocking gloves, used by volleyball players to hold their hands together in a "clapping" position, whereby a player can practice certain volleyball motions, such as the two-hand underhanded volley or forearm bump. These gloves are not designed or intended to be used with any other equipment.

U.S. Pat. No. 4,665,565 entitled GOLF GLOVE which issued on May 19, 1987 to T. J. Odom describes a pair of "interlocking" golf gloves. However, the Odom patent refers repeatedly to the use of "loop and pile" fasteners. As known by those skilled in the art, fastening strips, such as those known by the trademark "VELCRO®" include a "loop" portion and a complementary "hook" portion. The "hook" portion includes small deformable hooks which releasably interlock with the pile of the "loop" portion. Thus, the use of the term "loop and pile" fasteners by Odom appears to be incorrect, particularly since Odom refers to one type of such "loop and pile" fasteners as being available under the "VELCRO®" trademark. The gloves described by Odom are not symmetrical, and they are very similar to those described in the Osborn patent described above.

U.S. Pat. No. 5,028,050 entitled GOLFER'S GRIP TRAINING DEVICE which issued on Jul. 2, 1991 to H. Freyer describes training gloves for golfers in which a hook (or loop) strip on the outer portion of a thumb of one glove interlocks with a complementary loop (or hook) fastener in the palm of the other glove, while a hook (or loop) fastener which is between the first and second fingers of the first glove interlocks with loop (or hook) fasteners which run along the outside of the little finger of the other glove. The configuration of the coacting portions of the gloves disclosed by Freyer are not symmetrical, so different designs are required for left-handed and right-handed golfers.

U.S. Pat. No. 5,184,827 entitled AUDIBLE GOLF GLOVES which issued on Feb. 9, 1993 to K. Suttle, et al. includes cooperating thumb and palm strips, much like those described by Freyer. Again, different designs are required for left-handed and right-handed golfers.

U.S. Design Pat. No. 417,312 entitled BATTING GLOVE WITH ATTACHED HOOKS AND LOOPS which issued on Nov. 30, 1999 to S. Hoefs describes an ornamental design for a batting glove with attached hooks and loops. However, this design patent, includes no enabling disclosure sufficient to teach someone skilled in the art how to make batting gloves having the utility of the present invention. In addition, as will be recognized by those skilled in the art, hook and loop fasteners, such as those called VELCRO®, have distinct appearances in that the "loop" material has a "fuzzy" appearance, while the "hook" material has a very uniform, "regular" appearance. In the figures of the drawing in the Hoefs patent, each of the strips which are visible appear to have the "fuzzy" appearance of loop material. Accordingly, it is unclear whether there was any use of loop material, notwithstanding the title of the patent or the description of the figures of the drawing. However, as this is a design patent, fulfilling utilitarian requirements is not a prerequisite, and, as shown and claimed, the gloves in the Hoefs patent need be nothing more than "ornamental".

Thus, none of the foregoing patents, either singly or in combination, discloses or suggests a way to design batting gloves which are intended to interact to keep the hands of a batter together.

SUMMARY OF THE INVENTION

The present invention provides a pair of interlocking batting gloves which prevent a batter from rotating his hands while gripping a bat. In addition, the gloves of the present invention also maintain proper alignment of a batter's knuckles throughout his entire swing. The present invention overcomes all of the disadvantages of the previously known devices.

In brief, each glove of the present invention comprises a thumb portion, a plurality of finger portions, a main hand portion, and a wrist portion. The left and right hands gloves are mirror images of each other, whereby the same pair of gloves can be worn by either a left-handed batter or a right-handed batter. A batter who is a "switch" hitter, need not have more than one pair of gloves in accordance with the present invention.

Each glove of the present invention further has hook (or loop) fasteners attached to the outer peripheral edge of the index finger portion of the glove and a cooperating loop (or hook) fastener attached to the outer peripheral edge of the little finger of each glove. Thus, when the batter correctly grips a bat, the hook (or loop) fastener along the peripheral edge of the batter's index finger on one hand engages the cooperating portion of the loop (or hook) fastener on the outer peripheral edge of the batter's little finger on the other hand, thereby releasably connecting the batter's hands together in the proper relationship during the entire swing of the bat. Furthermore, the hook and loop fasteners on each of the gloves cooperate with each other either right-handed or left-handed batters. The configuration of the hook and loop fasteners may be an elongated strip or they may be discontinuous, e.g., such as a configuration of circles, squares, ovals, or other shapes. The purpose of having discontinuous fasteners, which are preferably located along an imaginary axis of the batter's finger, is to enhance flexibility of the finger portions of the glove, as the plastic material of which the hook and loop fasteners are typically made tends to be somewhat stiff and inflexible. By forming the fasteners in a discontinuous fashion the spaces between the fasteners retains the flexibility of the glove material which is typically a natural or artificial leather.

Thus, the present invention provides a cooperating pair of gloves which eliminates the problem of a batter rotating his hands while gripping, and/or swinging, a bat. The present invention also provides a device which maintains proper alignment of the batter's knuckles throughout the entire swing. Both of these advantages are achieved by the present invention in a manner that does not limit the flexibility of the batter's fingers while using the device.

The symmetry of the present invention allows the same pair of gloves to be used while batting either right-handed or left-handed, thus eliminating the need, on the part of a manufacturer, to make both left-handed and right-handed gloves, and it eliminates the expense, on the part of a "switch" hitter of having to buy two pairs of gloves. A player may switch from right-handed batting to left-handed batting without the inconvenience of removing the gloves and replacing them with another pair. Other advantages of the present invention are its convenience, ease of use and affordability.

Children and adults alike can improve the form of their batting swing, thereby attaining greater accuracy in hitting and further distance on the baseball when using the present invention. Still further advantages of the invention will become readily apparent to those skilled in the art to which the invention pertains upon reference to the following detailed description.

DETAILED DESCRIPTION OF EXEMPLARY EMBODIMENTS

Figure 1:
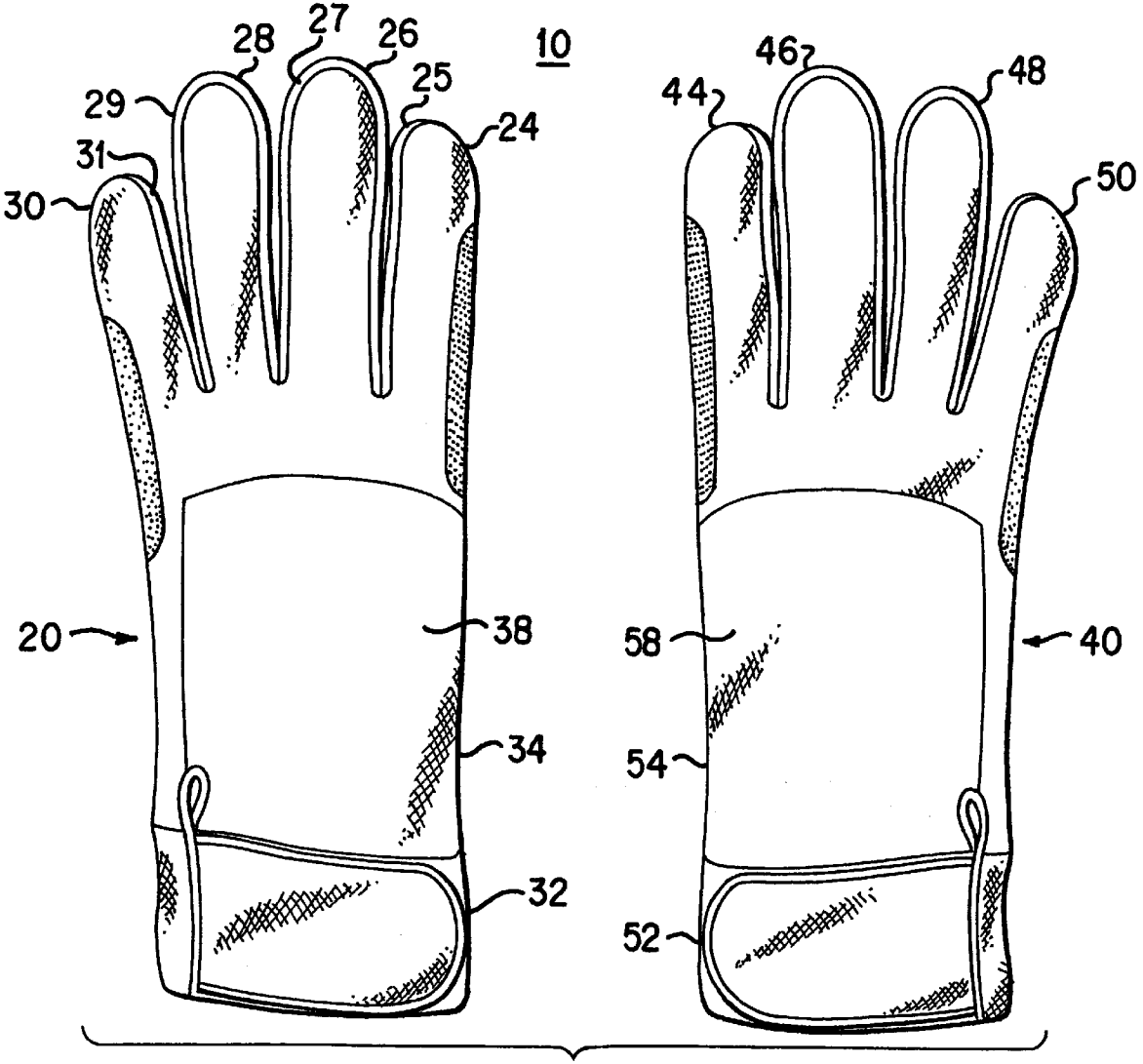
FIG. 1 is a rear (palms down) view of the pair of gloves of the present invention.
Figure 2:
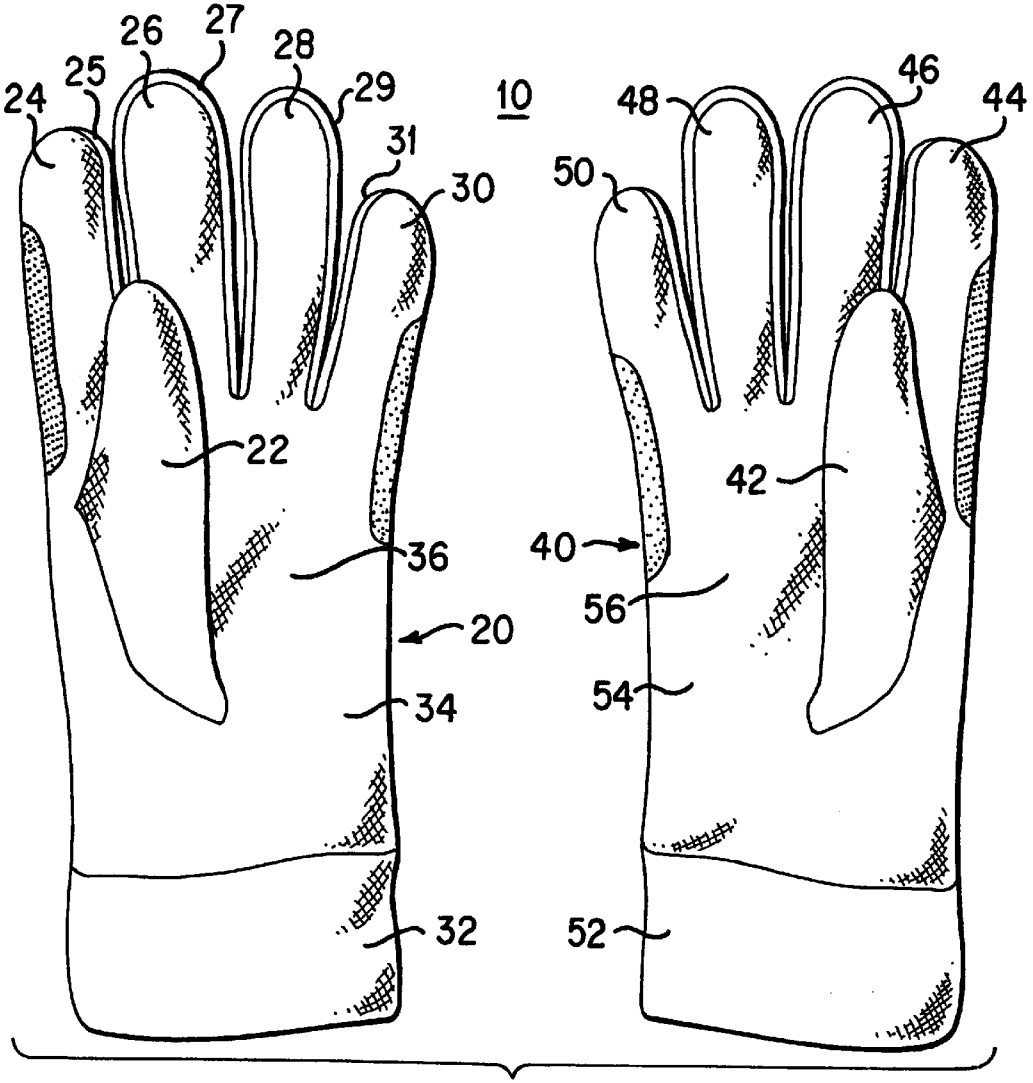
FIG. 2 is a view of the pair of gloves of the present invention with the palms facing up.

Referring first to FIGS. 1–2, a first preferred embodiment of a pair of batting gloves 10 in accordance with the present invention, is shown. In the preferred embodiment, the gloves 10 include a left glove 20 and a right glove 40. The left glove 20 includes a thumb portion 22, an index finger portion 24, a middle finger portion 26, a ring finger portion 28, a small ("pinky") finger portion 30, a wrist portion 32, and a main glove portion 34 adapted for respectively receiving the thumb, index finger, middle finger, ring finger, little finger, wrist, and hand of a human being in the conventional manner. The thumb portion 22 and each finger portion 24, 26, 28, 30 extend outwardly from the main glove portion 34. The wrist portion 32 attaches to the main glove portion 34 on the side of the glove 20 opposite the finger portions 24, 26, 28, 30.

Similarly, the right glove 40 includes a thumb portion 42, an index finger portion 44, a middle finger portion 46, a ring finger portion 48, a little finger 50, a wrist portion 52 and a main glove portion 54 adapted for respectively receiving the thumb, index finger, middle finger, ring finger, little finger, wrist, and hand of a human being in the conventional manner. The thumb portion 42 and each finger portion 44, 46, 48, 50 extend outwardly from the main glove portion 54. The wrist portion 52 attaches to the main glove portion 54 on the side of the glove 40 opposite the finger portions 44, 46, 48, 50. Further, the main glove portion 34 of the left glove 20 has a palm side 36 and a rear side 38. The main glove portion 54 of the right glove 40 has a palm side 56 and a rear side 58.

Additionally, in the preferred embodiment 10, the left glove 20 and the right glove 40 are preferably mirror images of each other, so only the right glove 40 will be described in detail hereinafter, it being understood that a like description applies to the left glove 20.

In the preferred embodiment of the invention, the palm side 36 of the main glove portion 34, the palm side and rear sides of the finger portions 24, 26, 28, 30, and the entire thumb portion 22 of the glove 20 is constructed from a leather, or leather-like, material, such as Cabretta leather which is used in the preferred embodiment of the invention. The rear side 38 of the main glove portion 34 and the inner peripheral edges 25, 27, 29, 31 of the finger portions 24, 26, 28, 30, respectively, including the areas covering the webbing of the finger portions 24, 26, 28, 30, are constructed of a flexible material, such as Spandex® in the preferred embodiment of the invention, as such material allows the user's hands to breath while in the gloves 10. The material comprising the palm and rear sides 36, 38 of the glove 20 are sewn together in a manner well known to those skilled in the glove art.

Figure 3:
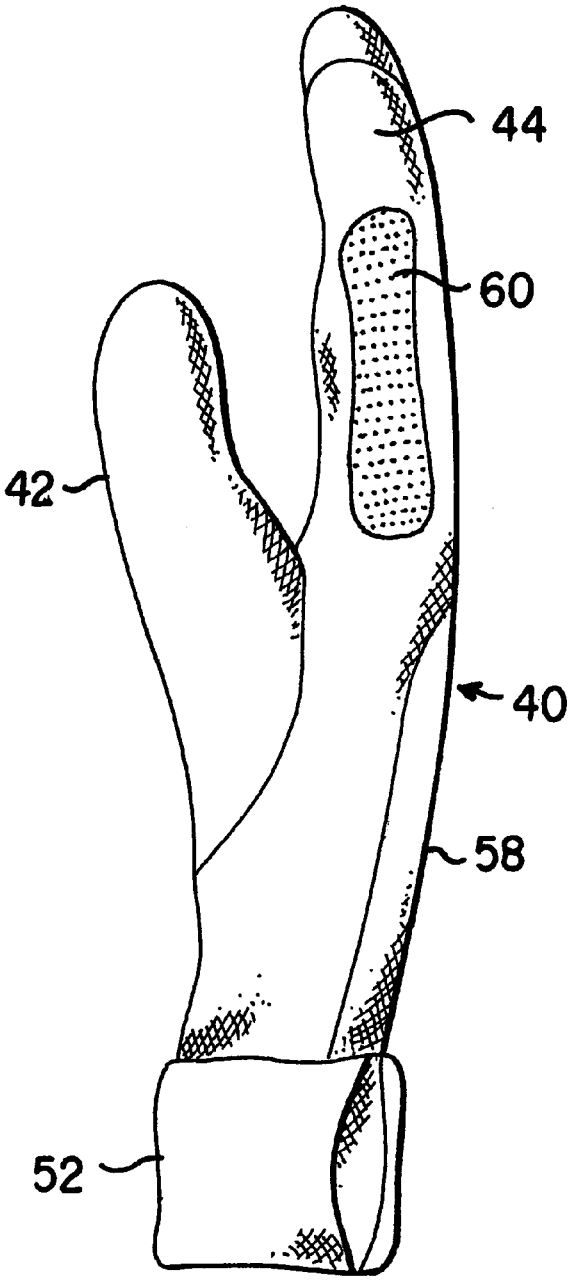
FIG. 3 is a thumb-side view of the right glove of the present invention.

Referring now to FIG. 3, fastener means 60 is attached to the outer peripheral edge of the index finger portion 44 of the glove 40. In the first preferred embodiment, the fastener means 60 is comprised of an elongated strip of hook (or loop) material located substantially along an imaginary axis of that portion of the glove 40 into which the user's index finger will be placed. In the first preferred embodiment, the strip is approximately 3 inches (7.62 cm) long and about 0.75 inches (1.90 cm) wide, and it begins approximately 0.5 inches (1.27 cm) below the tip of the index finger portion 44 of the glove 40, e.g., along the center line of the index finger portion 44. As will be obvious to those skilled in the art, larger or smaller dimensions would be used in manufacturing larger or smaller gloves.

Figure 4:
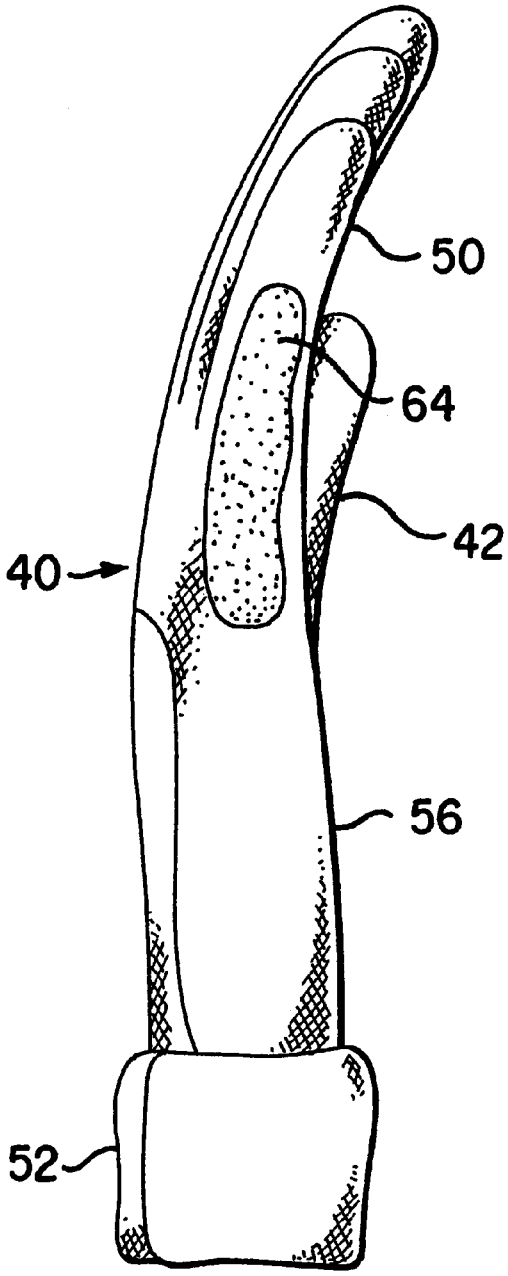
FIG. 4 is a small finger (pinky) side view of the right glove of the present invention.

Referring to FIG. 4, cooperating fastener means 64 is attached to the outer peripheral edge of the little finger portion 50 of the glove 40. As used herein, the term "cooperating fastener means" refers to loop material, where the fastener material with which it is to be joined is hook material. Where the fastener material to be joined is loop material, then the "cooperating fastener means" would, of course, be hook material. In the first preferred embodiment of the invention, cooperating fastener means 64 is comprised of an elongated strip of and loop material located an imaginary axis of the glove's little finger ("pinky") portion 50. In the first preferred embodiment of the invention, the strip 64 is approximately 3 inches (7.62 cm) long and about 0.75 inches (1.90 cm) wide, and it begins approximately 0.5 inches (1.27 cm) below the tip of the little finger portion 50 of the glove 40, along the center line of the glove's little finger portion 50.

When a user properly grips a bat while wearing the gloves 10, the fastener means 60 on one of the gloves engages the cooperating fastener means 64 on the other glove thereby releasably connecting the outside (the side toward the thumb) of the index finger portion 24 of one glove 20 to the outside of the little finger portion 30 of the other glove 40 or vice versa, depending on the dominant hand of the user. It should be understood that if fastener means 60 is "hook" material then cooperating fastening means 64 will be "loop" material and vice versa. The symmetry of the placement of fastener means 60 and cooperating fastener means 64 on gloves 10 allows for use of the same pair of gloves 10 by both right-handed and left-handed batters. Therefore the expenses of the manufacturer in having to provide batting gloves for both left-handed and right-handed batters, the expense of a retailer who would have to stock gloves for both left-handed and right-handed batters, and the expense of a "switch" hitter, who would have to buy two separate pairs of gloves designed for either right-handed, or left-handed batters, is eliminated. Further, switch-hitters may switch from right-handed batting to left-handed batting without the inconvenience of removing the gloves 10 and replacing them with a separate pair.

Figure 5:
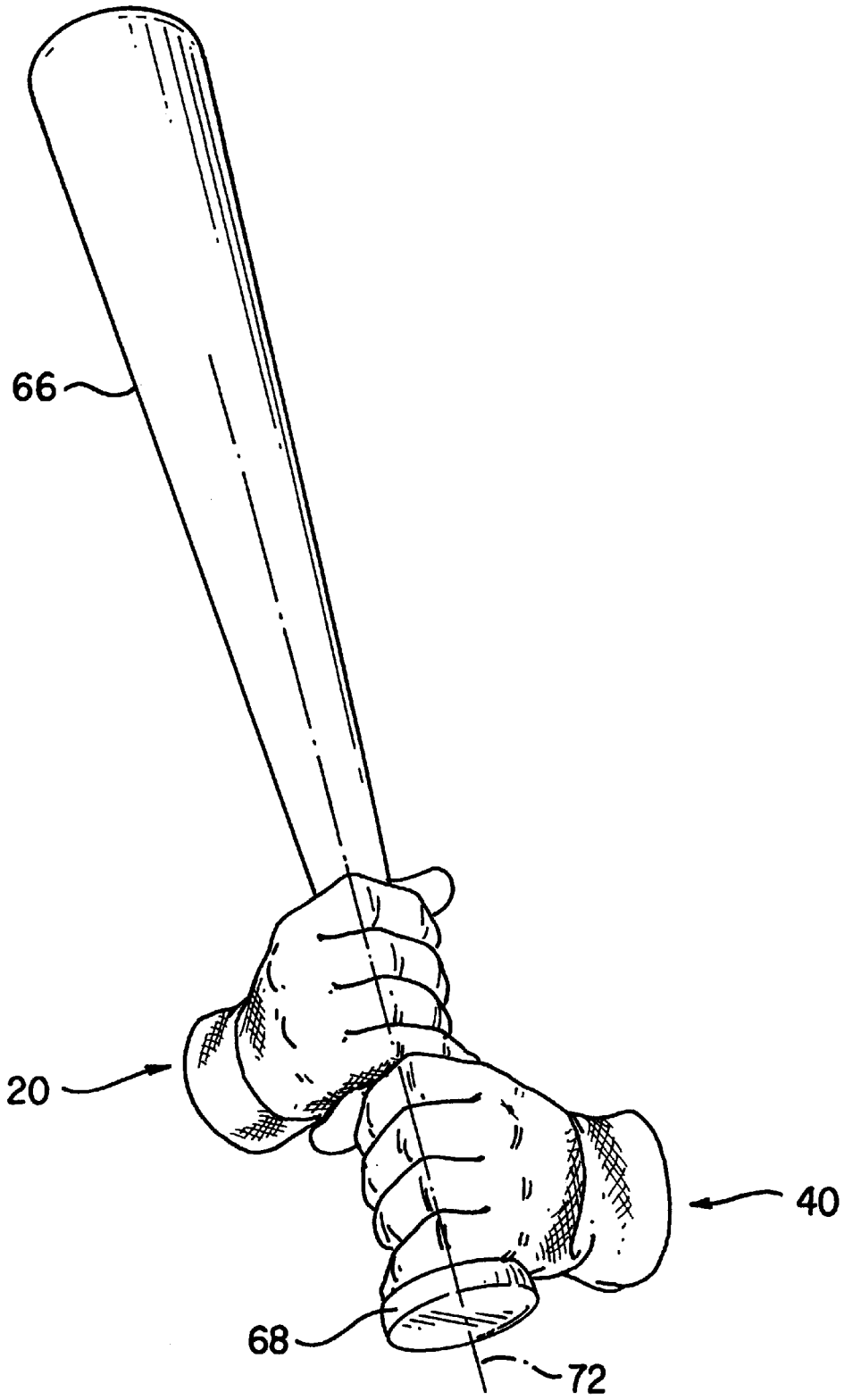
FIG. 5 illustrates proper alignment of a batter's knuckles along an imaginary axis, using the gloves of the present invention.

As shown in FIG. 5, in which a right-handed batter is illustrated, to use the gloves 10, the batter inserts his left hand into the left glove 20 and his right hand into the right glove 40 in the conventional manner. The batter then grips the shaft of the bat 66 at the bottom portion closest to the knob 68 of the bat 66 with his non-dominant hand. The batter then grips the center of the shaft of the bat 66 with his dominant hand. Next, the batter slides his dominant hand down the shaft of the bat 68, properly aligning his knuckles on the way down, until the batter's dominant hand comes into contact with the non-dominant hand. The batter then firmly presses his hands together, causing the fastener means 60 on the glove 40 of the dominant hand to engage the cooperating fastener means 44 on the glove 20 of the other hand and thereby releasably connecting the index finger portion 54 of one glove 40 to the little finger portion 30 of the other glove 20. Thus, the batter is prevented from rotating his hands while gripping the bat 66. Also, the gloves 10 maintain proper alignment of the batter's knuckles along an imaginary axis 72 as shown in FIG. 5. Proper knuckle alignment is maintained throughout the swing, resulting in improved form of the batter's swing, thereby achieving greater accuracy in hitting and further distance on the baseball for the batter when using the present invention.

Figure 6:
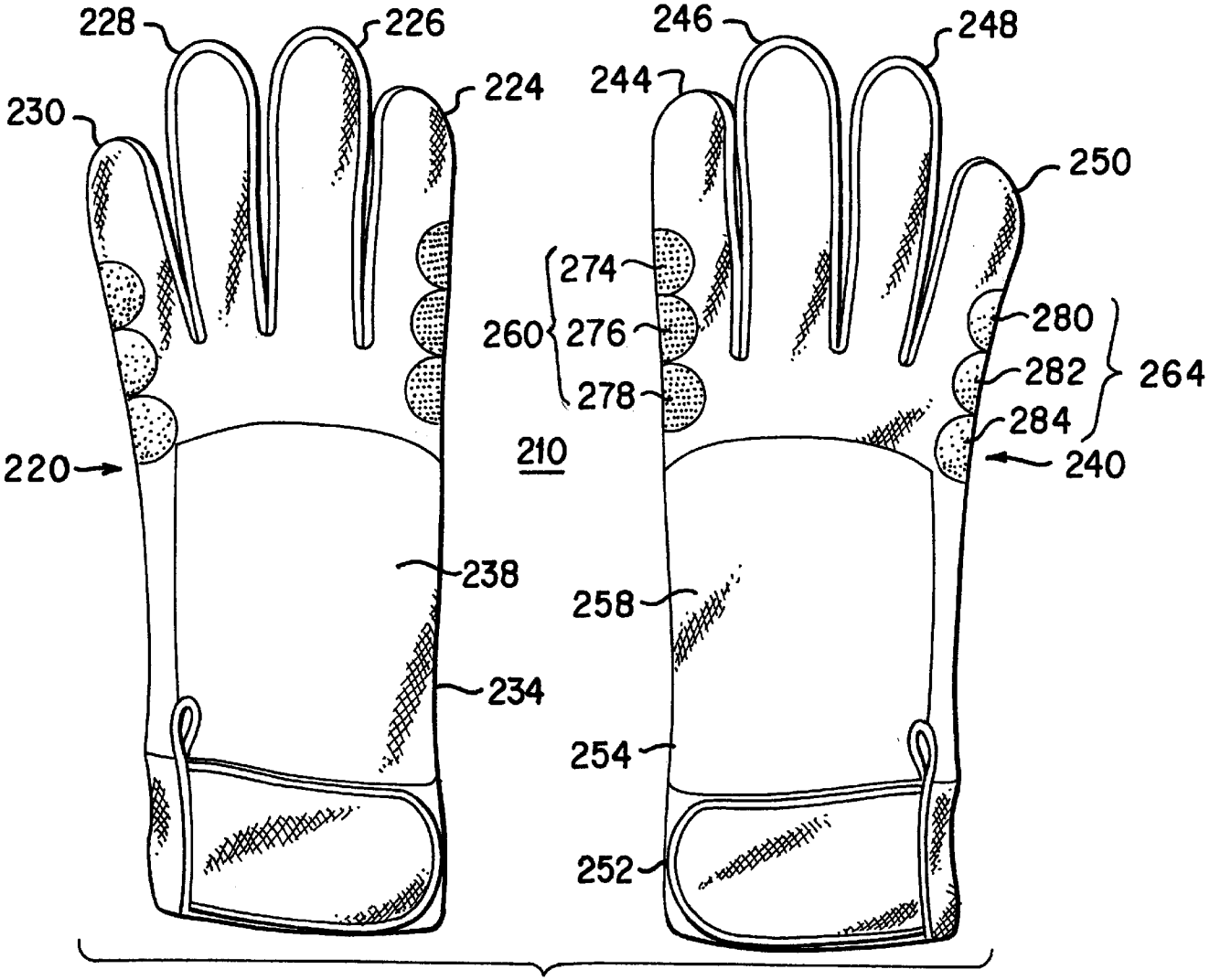
FIG. 6 is a rear view of the gloves of a second embodiment of the present invention.
Figure 7:
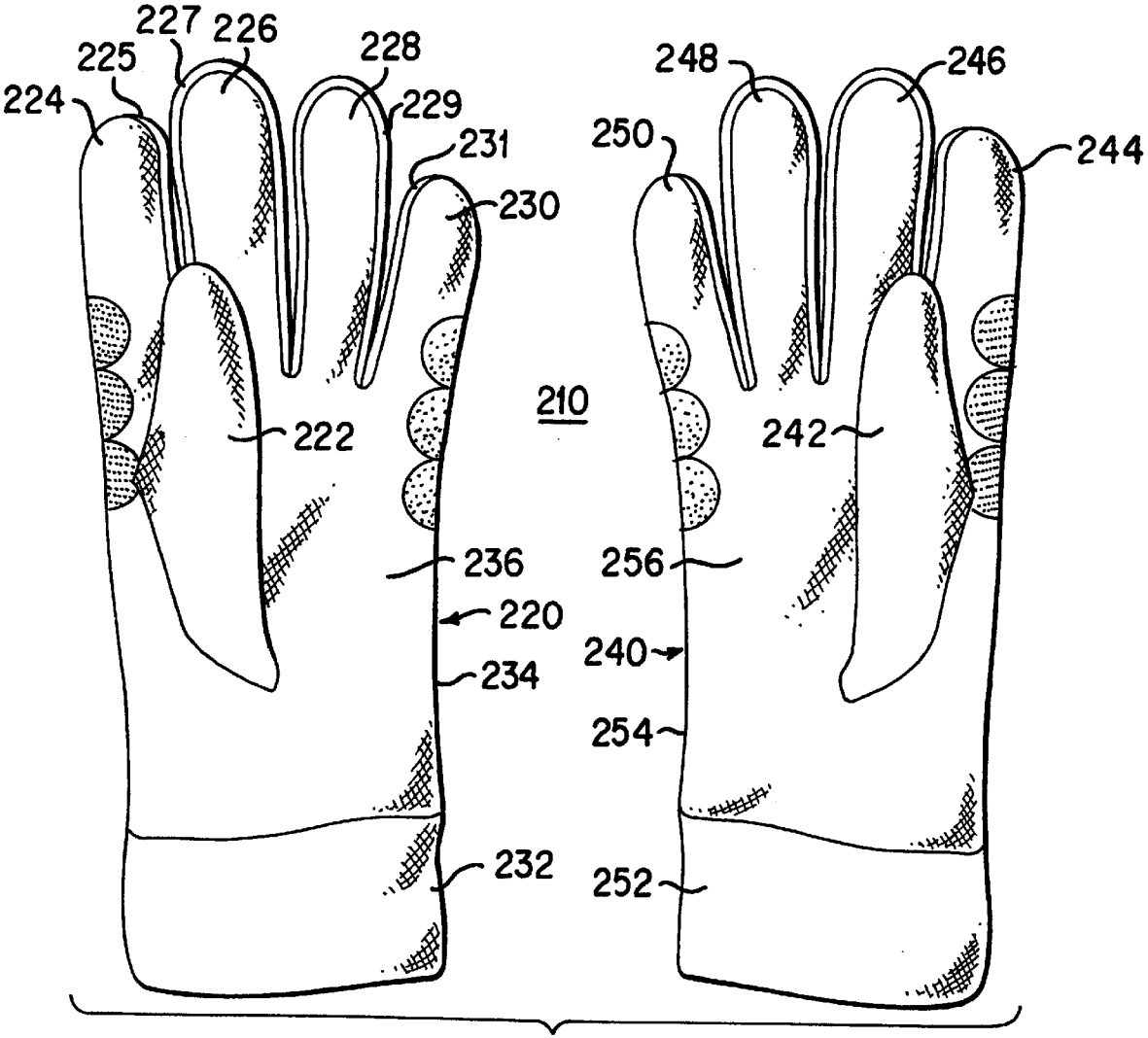
FIG. 7 is a view of the pair of gloves of the second embodiment of the present invention with the palms facing up.
Figure 8:
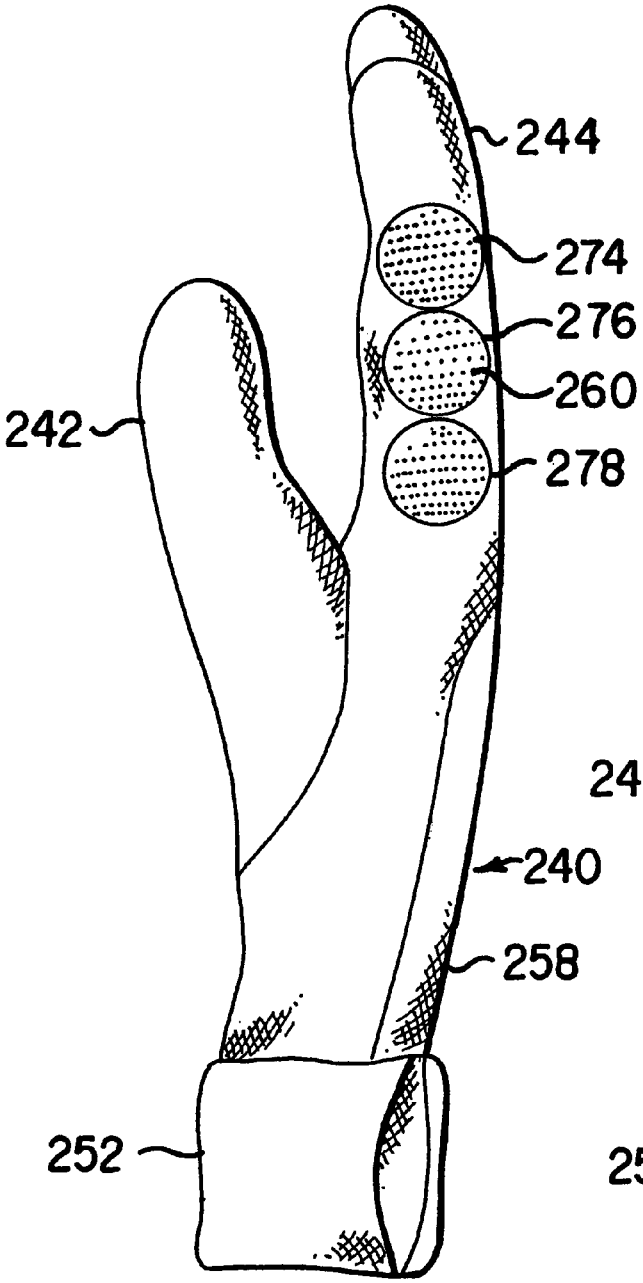
FIG. 8 is a thumb-side view of the right glove of the second embodiment of the present invention.
Figure 9:
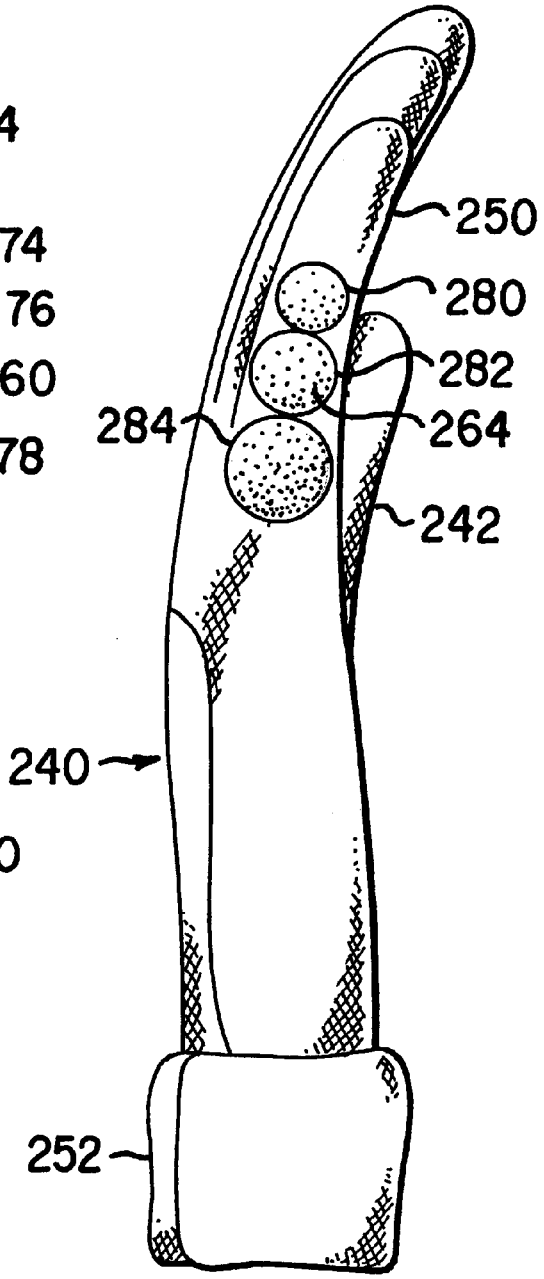
FIG. 9 is a pinky-side view of the right glove of the second embodiment of the present invention.

A second preferred embodiment 210 is shown in FIGS. 6–8. Identifying reference designators for this second embodiment are marked similarly to the first embodiment, except with the prefix "2". It shall be understood that many aspects of the two embodiments are substantially the same, so only the differences will be treated in detail, it being understood that the similar structural features of the two embodiments 10, 210 perform similar functions.

Additionally, the left glove 220 and the right glove 240 are also mirror images of each other so that only the right glove 240 will be described in detail hereinafter, it being understood that a like description shall also apply to the left glove 220.

The only substantial difference between the second preferred embodiment 210 and the first preferred embodiment 10 is that, in the second preferred embodiment 210, the fastener means 60 is shown in one of many possible discontinuous configurations. In particular, the fastener means in the embodiment 210 is comprised of a plurality of small hook and loop fasteners, which are shown as circles 274, 276, and 278, each of which is comprised of hook (or loop material) centered along an imaginary axis of the user's index finger rather than being an elongated strip as shown in FIGS. 1–3 for the first embodiment. While each of the fasteners 274, 276, 278 on a single glove would normally be of the same material, those skilled in the art will understand that any of the fasteners 274, 276, 278 can be either hook or loop material, so long as the cooperating fastener means on the opposed glove is comprised of complementary material. In fact, the same is true with respect to any of the fasteners on either embodiment of the invention. Accordingly, it will be understood that all left gloves could contain only one type of material (hook or loop), while all right gloves contain only the complementary type of material (loop or hook), as the function of the fastener material is simply to join the gloves together.

In the second preferred embodiment 210 of the invention, cooperating fastener means 264 is also a discontinuous configuration comprising a plurality of circles 280, 282, 284 of loop (or hook) loop material centered along an imaginary axis of the user's little finger rather than being an elongated strip as shown in FIGS. 1–3 for the first embodiment 10. The purpose of the discontinuous configuration of fasteners is to enhance flexibility of the user's fingers when wearing the gloves 210. While circular pieces of fastener material are shown, other shapes could also be used. The gloves 210 of the second preferred embodiment are used in substantially the same manner as those of the first preferred embodiment 10. While the preferred embodiment of the invention illustrates three circular fasteners on each glove, those skilled in the art will recognize that the number and size of the fasteners can be varied depending upon the size of the gloves. Thus, it has been found preferable to use the following sizes and numbers of fasteners when this embodiment 210 is fabricated:

| Size | Diameter of Fasteners | Number of Fasteners |
|---|---|---|
| Youth XS | 0.5" | 3 each glove |
| Youth S | 0.5" | 4 each glove |
| Youth M | 0.5" | 4 each glove |
| Youth L | 0.5" | 4 each glove |
| Youth XL | 0.5" | 5 each glove |
| Adult S | 0.75" | 4 each glove |
| Adult M | 0.75" | 4 each glove |
| Adult L | 0.75" | 4 each glove |
| Adult XL | 0.75" | 4 each glove |

In the preferred embodiment, all patterns start 0.5 inches from the finger tips, although other patterns could be used, as well.

While the present invention has been described and illustrated with respect to preferred embodiments and a preferred use therefor, it is not to be so limited, because modifications and changes can be made which are within the full intended scope of the invention.

Thus, while it would normally be the case that a particular glove would have either hook (or loop) material on the index finger portion and loop (or hook) material on the little finger portion, the symmetrical nature of the present invention allows for one glove to have only hook fasteners, while the other glove would have only loop fasteners.

Also, while typical gloves are shown, the present invention merely requires the presence of cooperating materials on the index and little fingers. Thus, it is possible to make "gloves" in accordance with the present invention which have openings for the other fingers, but which do not enclose them. In fact, the tip portions of all of the fingers can be left open, and there is no need to provide anything more than an opening for a batter's thumb.

While a number of variations have been described, others will appear to those skilled in the art, and all such variations are intended to be included as variations of the present invetion.

I claim:

1. A pair of batting gloves, comprising:

(a) a left glove and a right glove, each glove having a thumb portion, a plurality of finger portions, a main hand portion, and a wrist portion adapted for respectively receiving the thumb, index finger, middle finger, ring finger, little finger, hand and wrist of a human being; and (b) said finger portion which is adapted to receive the index finger of said gloves having an outer peripheral edge proximal to said thumb portion, fastener means attached to said outer peripheral edge of at least one of the gloves and cooperating fastener means attached to said outer peripheral edge of at least the little finger portion of the other glove for releasably connecting the index finger portion of one glove to the little finger portion of the other glove when a wearer of the gloves grips a bat, said fastener means being comprised of a plurality of pieces of hook or loop material having a discontinuous configuration centered along an imaginary axis of the user's index finger and said cooperating fastener means comprises a cooperating plurality of pieces of loop and hook material having a discontinuous configuration centered along an imaginary axis of the user's little finger.

2. The batting gloves of claim 1 wherein said fastener means and said cooperating fastener means are circular.

3. A pair of batting gloves, comprising:

(a) a left glove and a right glove, each glove having a thumb opening, an index finger portion, a plurality of finger openings, a little finger portion, a main hand portion, and a wrist portion adapted for respectively receiving the thumb, index finger, middle finger, ring finger, little finger, hand and wrist of a human being; and (b) said finger portion which is adapted to receive the index finger of said gloves having an outer peripheral edge proximal to said thumb portion, fastener means attached to said outer peripheral edge of at least one of the glove and cooperating fastener means attached to said outer peripheral edge of the little finger of the opposed glove for releasably connecting the index finger portion of one glove to the little finger portion of the other glove when the user grips a bat, said fastener means comprising a plurality of discontinuous pieces of hook or loop material having an alignment which substantially centers said pieces along an imaginary axis of the glove's index finger portion and said cooperating fastener means comprising a cooperating plurality of pieces of loop or hook material having a discontinuous configuration centered along a imaginary axis of a wearer's little finger;

whereby alignment of the knuckles of the left and right hands of the user is maintained along an imaginary axis throughout a batting swing.

4. The batting gloves of claim 3 wherein said fastener means and said cooperating fastener means are circular in shape.

5. A method of aligning the hands of a batter using gloves comprising:

(a) providing the batter with a left hand glove and a right hand glove, each glove including means for releasably connecting the portion closest to the thumb of the index finger of the non-dominant hand of the batter to the portion furthest from the thumb of the little finger of the dominant hand of the batter; and (b) having the batter grasp a bat such that the knuckles of the batter's hands are in alignment when the gloves are brought together, whereby the batter's hands will be releasably retained in the correct batting position along an imaginary axis throughout a batting swing.

* * * * *